United States Patent [19]

Hill et al.

[11] Patent Number: 5,074,595

[45] Date of Patent: Dec. 24, 1991

[54] RESEALABLE FOLDED LABEL STRUCTURE

[75] Inventors: Marilyn Hill, Mt. Gretna; Byron L. Baker, York, both of Pa.

[73] Assignee: York Tape and Label Company, York, Pa.

[21] Appl. No.: 643,361

[22] Filed: Jan. 22, 1991

[51] Int. Cl.[5] ..... B42D 45/00; B65D 27/34

[52] U.S. Cl. ..... 283/81; 229/92.1; 281/5

[58] Field of Search ..... 229/74, 92.1, 92.3; 281/2, 5; 283/81

[56] References Cited

U.S. PATENT DOCUMENTS

| | | | |
|---|---|---|---|
| 4,529,229 | 7/1985 | Glibbery | 283/81 |
| 4,534,582 | 8/1985 | Howard | 283/81 |
| 4,621,837 | 11/1986 | Mack | 283/105 |
| 4,726,972 | 2/1988 | Instance | 428/40 |
| 4,744,161 | 5/1988 | Instance | 283/81 X |
| 4,744,591 | 5/1988 | Instance | 283/81 X |
| 4,747,618 | 5/1988 | Instance | 281/5 |
| 4,773,584 | 9/1988 | Instance | 229/74 |
| 4,850,613 | 7/1989 | Instance | 283/81 |

*Primary Examiner*—Paul A. Bell

*Attorney, Agent, or Firm*—Samuel M. Learned, Jr.

[57] ABSTRACT

An improved resealable folded label structure provided with a graduated pressure-sensitive adhesive profile which is applied to the label front cover contact side of an outer protective overlaminate so that the label cover adhesion surface and hinge connecting tab portion of the outer protective overlaminate have a substantially thicker pressure-sensitive adhesive layer than does the over-lap opening and resealing tab portion thereof, such that if a user inadvertently attempts to open the label from the hinge tab side, being the wrong side, the extra adhesive thickness applied thereto will provide sufficient adhesion to prevent delamination damage to the label until such time as the user realizes their error and then proceeds to open the label from the proper overlapping reseal tap side.

7 Claims, 2 Drawing Sheets

1/3X
2/3X
X
10
12
14
16
18
20
22
24
26
28
30
32
34
36
38
40
42
44
48

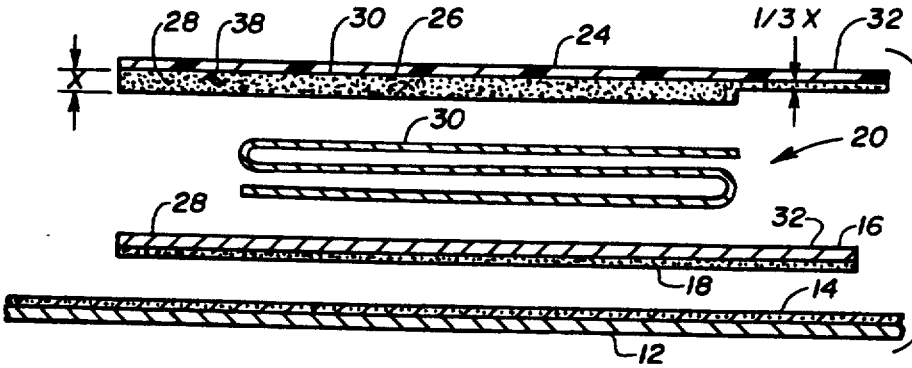
Fig. 4
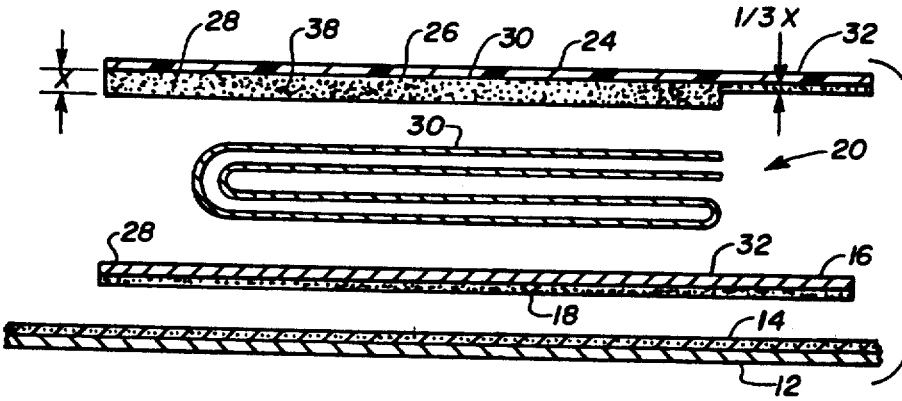
Fig. 5
Fig. 6
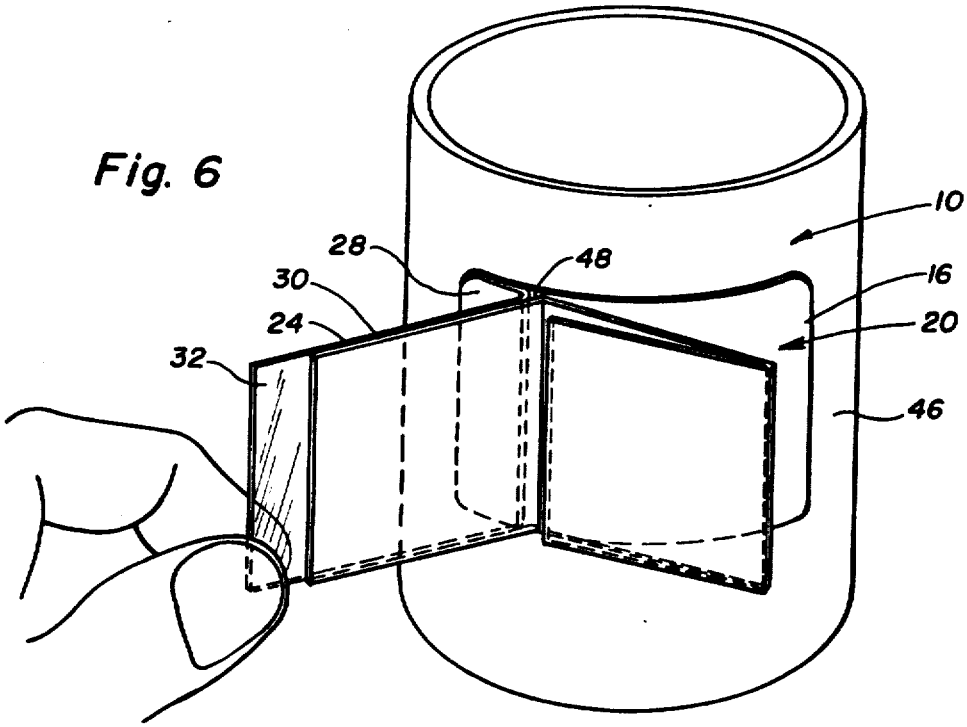

RESEALABLE FOLDED LABEL STRUCTURE

BACKGROUND OF THE INVENTION

The present invention relates to an improved resealable folded label structure whereby the subject label embodies a capability for withstanding delamination damage which would normally otherwise be consequent from a user attempting to open the label from the wrong side.

With an advent of more stringent instructional and directional use requirements as regards various consumer products, exemplary of which would be a broad spectrum ranging from over-the-counter health substances to small household appliances and power tools, there has become an increasing need to provide extended text direction and use labels that attach either directly to the product, or in the case of pills or the like directly to the product container. And, because of size constraints, in balancing the required extended text label content with that of the container application space available, the so-called folded label came into popular use whereby the label structure is one that is compacted by folding and can be opened to reveal a series of panels or pages containing the directions or use information. It then became necessary to provide a protective package for the folded label so that the direction and use information contained thereon would remain affixed to the product or product container and be available for consumer reference throughout the useful life thereof, thus evolved the resealable folded label provided with a protective overlaminate film and some sort of a release and resealing tab.

Exemplary of typical resealable folded label structures shown by the prior art are those as respectively taught by Howard in U.S. Pat. No. 4,534,582 dated Aug. 13, 1985, which discloses a mechanical tounge-and-slit resealing means, and those of Instance in U.S. Pat. No. 4,726,972 dated Feb 23, 1988, and U.S. Pat. No. 4,744,161 dated May 17, 1988, which disclose different versions of an over-lapping releasably adhered resealing arrangement.

Exemplary of typical protective overlaminate film folded and resealable labels are those as shown by the various embodiments as taught by Mack in U.S. Pat. No. 4,621,837 dated Nov. 11, 1986, and that as taught by Instance in U.S. Pat. No. 4,744,591 dated May 17, 1988.

As is evident from an inspection of the foregoing resealable folded label structures, as well as would also be evident from an inspection of other resealable folded label structures of similar types, being typically exemplary of those which are currently available, it is possible for a consumer, as frequently occurrs, on first instance to inadvertently attempt to open the sealed folded label from the wrong side and thereby cause delamination damage to the label in such a way that it will not mechanically survive and meet the use and directional purposes for which it was intended to serve throughout the duration of the life of the packaged product to which it is applied.

The applicant's improved resealable folded label structure mechanically provides a built-in differential ease of opening capability structurally within the label profile which discourages user opening on the wrong side thereof and enhances user opening of the label on the proper side thereby substantially reducing the likelihood of the otherwise normally consequent delamination damage resultant therefrom through the new and novel technique of employing a graduated thickness of adhesive film upon the protective overlaminate label structure layer in a manner hereinafter more fully detailed and described.

SUMMARY OF THE INVENTION

It is the principal object of the present invention to provide an improved resealable folded label structure based on a graduated pressure-sensitive adhesive profile which is applied to the label front cover contact side of an outer clear protective overlaminate layer such that the label cover adhesion surface and hinge connecting tab portion of the clear protective overlaminate have a substantially thicker pressure-sensitive adhesive layer than does the over-lap opening and resealing tab portion thereof so that if a user inadvertently attempts to open the label from the hinge tab side the extra adhesive thickness applied both thereto and to the cover contact surface will provide sufficient adhesion to prevent delamination damage to the label until such time as the user realizes their error and proceeds to open the label from the intended over-lapping reseal tab portion side for accomplishing the proper resealable use thereof.

It is also an object of the present invention to provide an improved resealable folded label structure that incorporates an outer cover comprised of a clear protective overlaminate layer which is sufficiently adequate in both strength and durability to prevent damage to the inner contained label through subsequent and repeated opening and resealing cycles of use thereof.

It is a further object of the present invention to provide an improved resealable folded label structure which enables an increased instructional and promotional printed message space for a minimum application space on a product container.

Yet another object of the present invention is to provide an improved resealable folded label structure having a self-adhesive resealable capability which enables folded labels applied to product containers at retail sales sites which have been prematurely opened by either inadvertence or curiosity of customers to be salvaged by utilization of the reseal feature, thereby allowing the complete printed matter of the folded label to be neatly retained upon the product container, as intended, with the product for its expected life.

It is an additional object of the present invention to provide an improved resealable folded label structure which may be alternately employed as a resealable coupon structure.

Still another object of the present invention is to provide an improved resealable folded label structure or alternately a resealable coupon structure, both of which can be manufactured by currently available machine technology and supplied in either sheet form or roll form suitable for either manual or automated mechanical application to a wide variety of end use products and product containers.

The foregoing, and other objects hereof, will be readily evident upon a study of the following specification and accompanying drawings comprising a part thereof.

BRIEF DESCRIPTION OF THE DRAWINGS

FIG. 4 is a pre-assembly cross sectional view of the improved resealable folded label showing a 3-panel folded insert.

FIG. 5 is a pre-assembly cross sectional view of the improved resealable folded label showing a 4-panel folded insert.

FIG. 6 illustrates an exemplary product container with the improved resealable folded label structure of instant invention being shown applied and disposed in typical use application configuration thereon.

DETAILED DESCRIPTION OF THE INVENTION

Figures 1, 2A, 2B, 3:
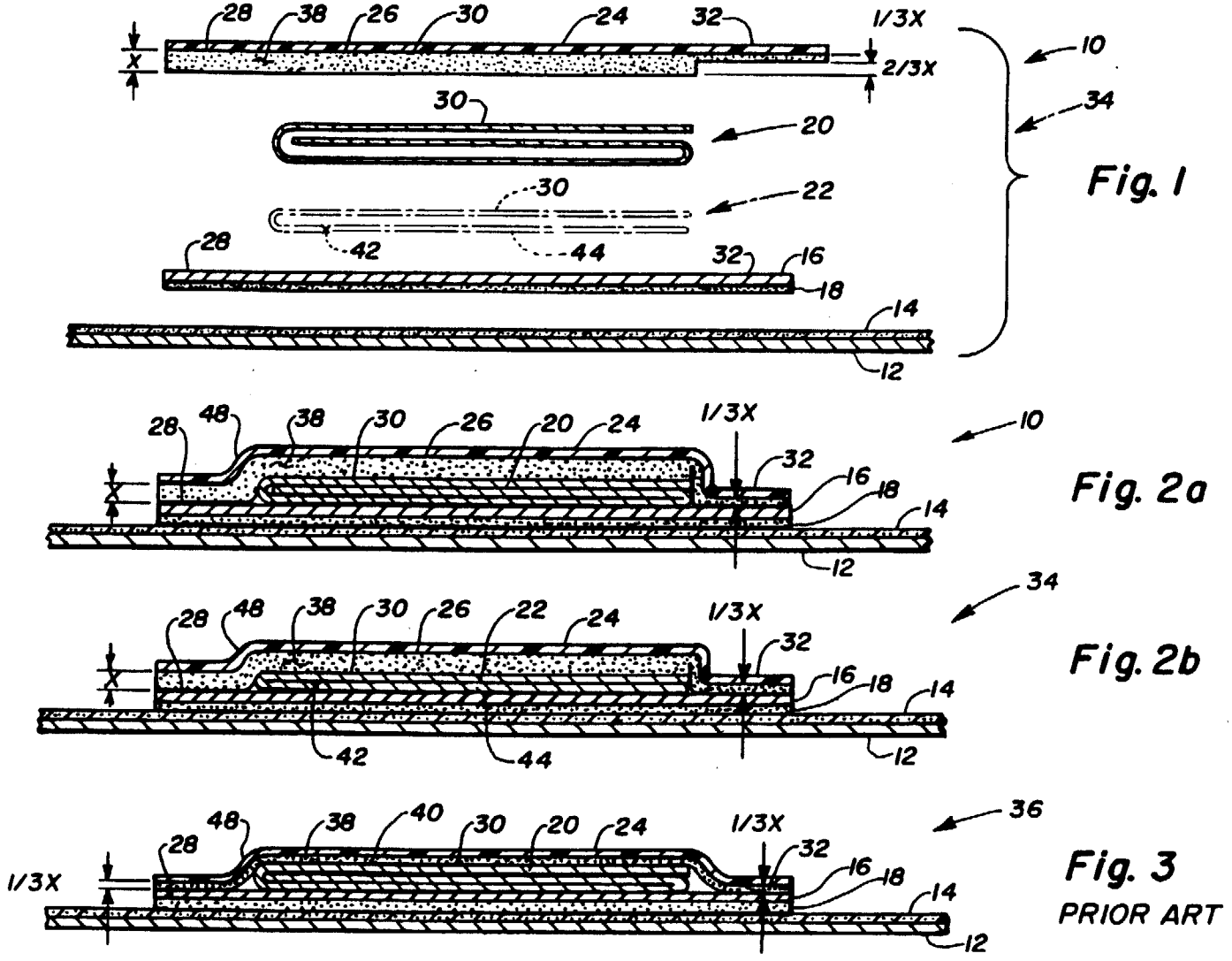
Fig. 3 PRIOR ART
FIG. 1 is a pre-assembly cross sectional view of the various laminated layer components comprising the improved resealable folded label structure of instant invention, showing both a folded label insert and in phantom a tear-out coupon as an alternate insert to that of the folded label.
FIG. 2*a* is an assembled cross sectional view of the improved resealable folded label structure with the folded label insert.
FIG. 2*b* is an assembled cross sectional view of the improved resealable folded label structure with the tear-out coupon insert.
FIG. 3 is an assembled cross sectional view of a typical prior art resealable folded label structure.

Referring to FIG. 1, the improved resealable folded label structure 10 of instant invention is illustrated in an exploded pre-assembly cross sectional view wherein the various laminate layer components comprising the same are shown, being from the bottom up the carrier liner backing paper 12 to which is applied a silicone release medium 14 in combination functioning to support and carry the remainder of the label structure prior to removal and application thereof to a use surface, then the film or paper base 16 of the label 10 structure to the underside of which is applied a layer of suitable label application pressure-sensitive adhesive 18 and the upper side of which base 16 serves to support the folded label insert 20 or alternately a coupon insert 22 as shown in phantom, and the label or coupon overlaminate film 24 having applied to the underside thereof a graduated pressure-sensitive adhesive profile 26 with a layer thickness of "X" over the hinge connecting tab portion 28 and the label cover or coupon cover adhesion surface 30 thereof and a reduced pressure-sensitive adhesive layer thickness differential of "⅓ X" upon the over-lap opening and resealing tab portion 32 thereof. It is this latter mentioned graduated adhesive layer to provide a differential pressure-sensitive adhesive profile thickness of "X" and "⅓ X" upon the overlaminate film 24, as shown in combination with either the folded label insert 20 or alternately coupon insert 22, to in turn provide a differential adhesive assembly resistance to opening between the hinge connecting tab portion 28 and the over-lap opening and resealing tab portion 32 of said label structure 10, which constitutes the essence of the present invention.

In the foregoing respect the thickness denomenated as "X" as shown in FIG. 1 and all subsequent Figures is the thicker portion of the graduated pressure-sensitive adhesive profile 26 and is preferably three-times the thickness of the thinner portion thereof which is that applied to the over-lap opening and resealing tab portion 32 of the overlaminate film 24.

Referring now to FIGS. 2*a* and 2*b*, which respectively illustrate assembled cross sectional views of the improved resealable folded label structure 10 with a folded label insert 20 and the alternate coupon insert improved resealable folded label structure 34 with a tear-out coupon insert 22, both in turn in cross sectional structural profile comparison to an exemplary typical prior art resealable folded label structure 36 having a folded label insert 20 as illustrated in FIG. 3. In all of the label illustration Figures of instant consideration it is seen that the basic laminate assembly cross sectional profiles in terms of the respective label component elements as above described are essentially the same, the exception between the improved versions 10 and 34 of instant invention and the prior art version 36 being that the overlaminate film to cover surface adhesive 38 in the improved versions 10 and 34 is that of a graduated pressure-sensitive adhesive profile 26 whereas in the prior art version 36 it is that of a uniform pressure-sensitive adhesive profile 40. With the respective improved version 10 and 34 graduated adhesive profile 26 as mechanically contrasted to the uniform adhesive profile 40 as exemplified by the prior art label 36 construction there is achieved in both the hinge connecting tab portion 28 and the cover adhesion surface 30 significant adhesion enhancement due to there being three-times the adhesive in the improved versions 10 and 34 as compared to the exemplary prior art label 36 which has typically only one-third the adhesive thickness in laminate layer areas of the hinge connecting tab portion 28 and the cover adhesion surface 30. In the area of the over-lap opening and resealing tab portion 32, however, whether applied to the improved label versions 10 and 34, or to the exemplary prior art label 36, the overlaminate film to cover surface adhesive 38 thickness is the same, being one-third "X" which is one-third that adhesive thickness applied to the continuous hinge tab 28 and cover adhesion 30 portions of the overlaminate film 24 of either of the improved label versions 10 and 34. Thus, if one attempts to open the improved label 10 or 34 from the side of the hinge connecting tab portion 28, which is the wrong side, it is appreciably more difficult to do so since there is three-times as much adhesive 38 as on the hinge connecting tab portion 28 of the exemplary prior art label 36 or over-lap opening and resealing portions 32 of any of the labels 10, 34, or 36 regardless of whether improved or prior art.

The thickness "X" of a typical graduated pressure-sensitive adhesive profile 26 will depend on a number of factors, but primarily on the nature of a particular label application and the use environment to which it will be exposed, as well as the particular adhesive characteristics thereof in mechanically joining the overlaminate film 24 to the cover adhesion surface 30 of either a label insert 20 or coupon insert 22 as well as also to the film or paper base 16. Typically, however, the thickness range of the "X" profile portion of the graduated pressure-sensitive adhesive will be generally within the range of 0.00072-inch to 0.00088-inch, with the over-lap opening and resealing tab portion 32 adhesive profile thickness being "⅓ X" for any particular pressure-sensitive adhesive used which would be generally within the range of 0.000234-inch to 0.000286-inch.

It will be further noted that the alternate coupon insert improved resealable folded label structure 34 version, as respectively shown in FIGS. 1 and 2*b*, is provided with a perforation 42 so that when the label structure 34 is opened by detachably lifting the over-lap opening and resealing tab portion 32 thereof, the coupon 44 may be tearably removed.

Directing attention now to FIGS. 4 and 5, which respectively illustrate a pre-assembly cross sectional view of the improved resealable folded label structure 10 showing a 3-panel folded label insert 20 and similar pre-assembly cross sectional view of the improved resealable folded label structure 10 showing a 4-panel folded label insert, which are typical improved label structure 10 profiles and serves to demonstrate the flexibility thereof in accommodating both a variety of label insert 20 fold patterns as well as the plurality of panels comprising the number of pages in a particular label.

In the respective improved resealable folded label structures 10 shown in FIGS. 4 and 5, as well as those previously shown in FIGS. 1, 2*a* and 2*b*, the label application pressure-sensitive adhesive 18 and the overlaminate film to cover surface adhesive 38 may be the same or different, depending on the adhesive characteristics called for in accomplishing satisfactory adhesion of the label to the use surface in the case of the label application adhesive 18, and as previously pointed out with regard to the adhesive 38 the nature of a particular label application and the use environment to which it will be exposed as well as the particular adhesive characteristics thereof in mechanically joining the overlaminate film 24 to the cover adhesion surface 30 of either a label insert 20 or coupon insert 22 as well as also to the film or paper base 16 for accomplishing the repeated cycle opening and resealing features thereof. The materials of construction for the remaining components of the improved resealable folded label structure 10 are those typically employed in making resealable folded labels, and are again specifically determined by factors such as the use environment to which the label will be exposed, the machine handling characteristics of the particular components in accomplishing automated label manufacture, the mechanical compatibility of the respective label components, and other such factors of the foregoing nature.

The automated mechanical equipment and fabrication techniques for manufacturing the improved resealable folded label structure 10 are likewise those which are currently available and typically employed in making folded labels.

Considering now the view shown in FIG. 6 which illustrates the opening and use of the improved resealable folded label structure 10 when applied to the surface of an exemplary product container 46 as said label 10 would be typically employed in use application. As can be seen, when the over-lap opening and resealing tab portion 32 is manually disengaged from that portion of the film or paper base 16 to which it is releasably and resealably adhered by a "½ X" film thickness of the adhesive 38, then that portion of the overlaminate film 24 which is adhesively bonded by an "X" film thickness of the adhesive 38 to both the label cover adhesion surface 30 and the hinge connecting tab portion 28 of the film or paper base 16 may be pivotally rotated about the label cover hinge 48 for opening and use of the folded label insert 20 as shown. Resealing of the improved label 10 is simply accomplished by refolding the label insert 20 in a manner the reverse of that by which it was unfolded, tucking the refolded label insert 20 flat against the supporting film or paper base 16, pivotally closing the overlaminate film cover 24 and resealing the over-lap opening and resealing tab portion 32 thereof to the film or paper base 16 and thereby effect a closable resealing of label 10.

Although the invention has been herein shown and described in what is conceived to be the most practical and preferred embodiment, it is recognized that departures may be made therefrom within the scope thereof, which is not to be limited to the specific details disclosed herein but is to be accorded the full scope of the claims so as to embrace any and all equivalent improved resealable folded label structures for use employment with either a folded label or coupon insert.

We claim:

1. An improved resealable folded label structure comprising in combination, a carrier liner backing paper having applied to the upper side thereof a silicone release medium, a film base having applied to the underside thereof a label application adhesive to detachably bond said film base to said silicone release medium, a folded label insert adapted to be supportably disposed upon the upward side of said film base and provide a hinge connecting tab portion one side thereof upon said film base and an over-lap opening and resealing tab portion the other side thereof upon said film base, an overlaminate film having applied to the underside thereof a graduated adhesive profile wherein the thickness of said graduated adhesive profile upon a corresponding over-lap opening and resealing tab portion thereof is less than that of the adhesive thickness on the remainder thereof which remainder is adapted to adhesively engage and laminately bond said overlaminate film to the hinge connecting tab portion of said film base and a label cover panel of said folded label insert and releasably bond said corresponding over-lap opening and resealing tab portion to the over-lap opening and resealing tab portion of said film base to provide an opening and resealing capability for said improved resealable folded label structure.

2. The improved resealable folded label structure according to claim 1 wherein said label application adhesive is a first pressure-sensitive adhesive.

3. The improved resealable folded label structure according to claim 2 wherein said graduated adhesive profile is comprised of a second pressure-sensitive adhesive.

4. The improved resealable folded label structure according to claim 3 wherein said first pressure-sensitive adhesive and said second pressure-sensitive adhesive are the same.

5. The improved resealable folded label structure according to claim 1 wherein the thickness of the graduated adhesive profile upon the corresponding over-lap opening and resealing tab portion of said overlaminate film is one-third that of the adhesive thickness on the remainder thereof.

6. A coupon insert improved resealable folded label structure comprising in combination, a carrier liner backing paper having applied to the upper side thereof a silicone release medium, a film base having applied to the underside thereof a label application adhesive to detachably bond said film base to said silicone release medium, a coupon insert adapted to be supportably disposed upon the upward side of said film base and provide a hinge connecting tab portion one side thereof upon said film base and an over-lap opening and resealing tab portion the other side thereof upon said film base, an overlaminate film having applied to the underside thereof a graduated adhesive profile wherein the thickness of said graduated adhesive profile upon a corresponding over-lap opening and resealing tab portion thereof is less than that of the adhesive thickness on the remainder thereof which remainder is adapted to adhesively engage and laminately bond said overlaminate film to the hinge connecting tab portion of said film base and a coupon cover panel of said coupon insert and releasably bond said corresponding over-lap opening and resealing tab portion to the over-lap opening and resealing tab portion of said film base to provide an opening and resealing capability for said coupon insert improved resealable folded label structure.

7. The coupon insert improved resealable folded label structure according to claim 6 wherein the thickness of the graduated adhesive profile upon the corresponding over-lap opening and resealing tab portion of said over-laminate film is one-third that of the adhesive thickness of the remainder thereof.

* * * * *